US008657156B2

(12) United States Patent
Hsu et al.

(10) Patent No.: US 8,657,156 B2
(45) Date of Patent: Feb. 25, 2014

(54) FEEDING DEVICE FOR A BALLS-SORTING MACHINE

(76) Inventors: Ya-Chen Hsu, Taichung (TW); Fang-Chih Tien, Taichung (TW); Yi-Ji Chen, Changhua (TW)

( * ) Notice: Subject to any disclaimer, the term of this patent is extended or adjusted under 35 U.S.C. 154(b) by 223 days.

(21) Appl. No.: 13/339,338

(22) Filed: Dec. 28, 2011

(65) Prior Publication Data

US 2013/0168406 A1 Jul. 4, 2013

(51) Int. Cl.
*G07F 11/00* (2006.01)

(52) U.S. Cl.
USPC ..... 221/265; 221/264; 221/263; 221/256

(58) Field of Classification Search
USPC ..... 221/256, 263, 264, 265
See application file for complete search history.

(56) References Cited

U.S. PATENT DOCUMENTS 865,923 A * 9/1907 Linsley ..... 211/119.17
2,621,096 A * 12/1952 Broyles et al. ..... 221/68
2,977,023 A * 3/1961 Meyer ..... 221/205
3,946,847 A * 3/1976 Bock ..... 194/253
4,667,847 A * 5/1987 Tucom ..... 221/68
5,009,330 A * 4/1991 Young et al. ..... 221/196
5,086,945 A * 2/1992 Corella ..... 221/13
5,097,985 A * 3/1992 Jones ..... 221/86
5,673,812 A * 10/1997 Nelson ..... 221/82
5,890,622 A * 4/1999 Farmont ..... 221/13
6,325,571 B1 * 12/2001 Ishida et al. ..... 406/85

* cited by examiner

*Primary Examiner* — Patrick Mackey
(74) *Attorney, Agent, or Firm* — Banger Shia

(57) ABSTRACT

A feeding device for a balls-sorting machine serves to guide balls to a rotary ball-carrying disc disposed in a housing, the ball-carrying disc is formed with a plurality of ball-falling holes. The feeding device comprises: a feeding hopper, a dividing device, and a control unit. The feeding hopper includes a feeding hole and a feeding passage connected to the housing. The dividing device is abutted against the ball-carrying disc and formed with a receiving space, and a sub-inputting hole and a sub-outputting hole which are in communication with the receiving space, the sub-inputting hole is connected to the feeding passage, and the sub-outputting hole is located corresponding to the ball-falling holes of the ball-carrying disc.

3 Claims, 8 Drawing Sheets

FEEDING DEVICE FOR A BALLS-SORTING MACHINE

BACKGROUND OF THE INVENTION

1. Field of the Invention

The present invention relates to a ball sorting machine, and more particularly to a feeding device for a balls-sorting machine.

2. Description of the Prior Art

Methods for sorting and checking balls generally include checking with naked eyes, or using light reflection to check out the balls' flaw, or just screening the balls with sizers or sieves. However, so far, it has not been that a machine can sort out the flaws on the surface of the balls automatically. The author of the application, after many years of hard work, has invented a feeding device for a ball sorting machine, wherein only one ball can pass through a ball-falling hole at a time for facilitating later checking and sorting process.

SUMMARY OF THE INVENTION

The primary object of the present invention is to provide a feeding device for a balls-sorting machine, wherein only one ball can pass through a ball-falling hole at a time for facilitating later checking and sorting process.

To achieve the above object, a feeding device for a balls-sorting machine in accordance with the present invention serves to guide balls to a rotary ball-carrying disc disposed in a housing, the ball-carrying disc is formed with a plurality of ball-falling holes. The feeding device comprises: a feeding hopper, a dividing device, and a control unit. The feeding hopper includes a feeding hole and a feeding passage connected to the housing. The dividing device is abutted against the ball-carrying disc and formed with a receiving space, and a sub-inputting hole and a sub-outputting hole which are in communication with the receiving space, the sub-inputting hole is connected to the feeding passage, and the sub-outputting hole is located corresponding to the ball-falling holes of the ball-carrying disc.

DETAILED DESCRIPTION OF THE PREFERRED EMBODIMENTS

Figure 1:
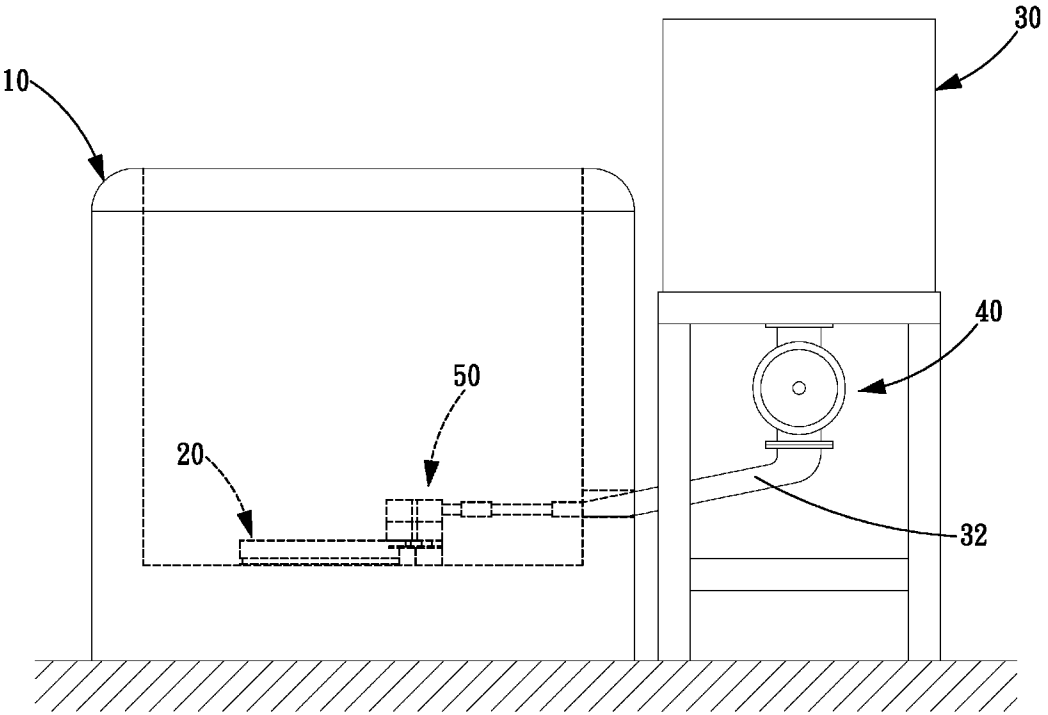
FIG. 1 is a side view of a feeding device for a balls-sorting machine in accordance with a preferred embodiment of the present invention.
Figure 2:
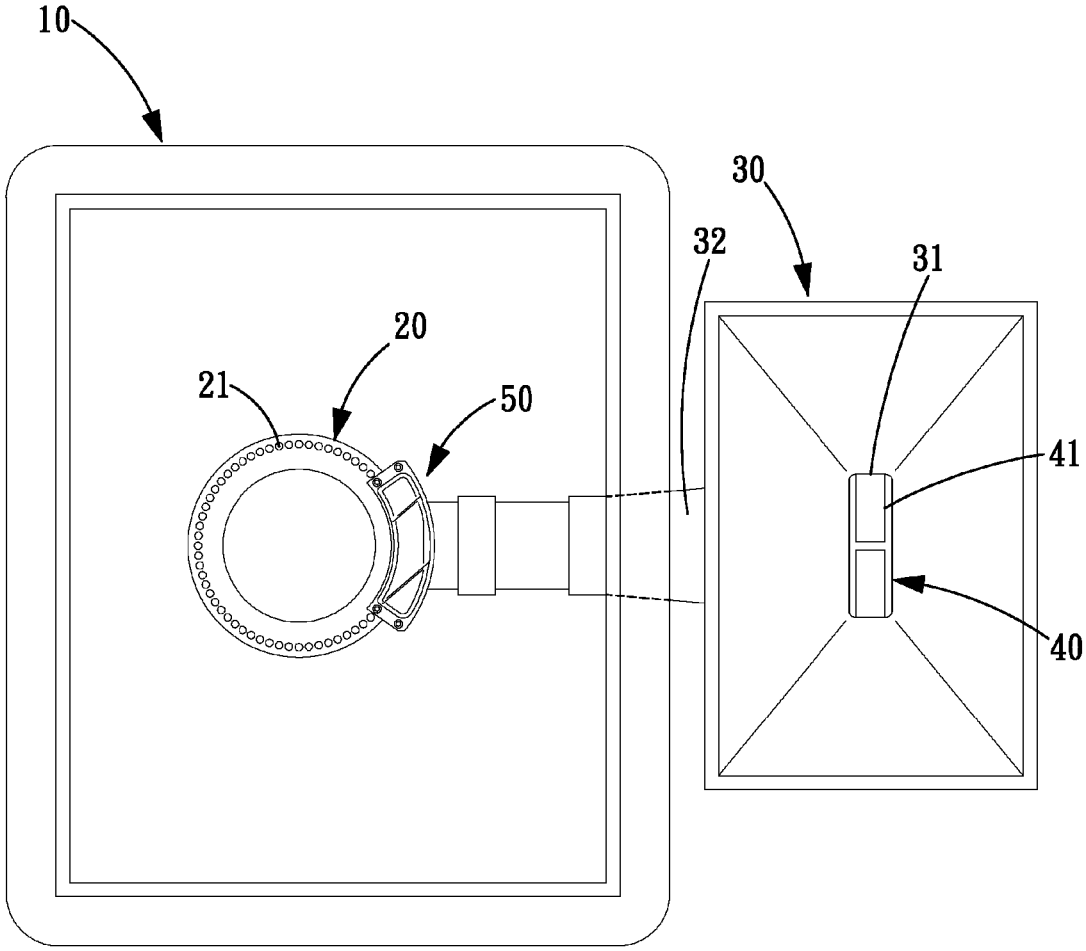
FIG. 2 is a top view of the feeding device for a balls-sorting machine in accordance with the present invention.

The present invention will be clearer from the following description when viewed together with the accompanying drawings, which show, for purpose of illustrations only, the preferred embodiment in accordance with the present invention.

Referring to FIGS. 1-5, a feeding device for a balls-sorting machine in accordance with a preferred embodiment of the present invention serves to guide balls A to a rotary ball-carrying disc 20 disposed in a housing 10. The balls have a diameter D1, the ball-carrying disc 20 is formed with a plurality of ball-falling holes 21 which have a depth of D2, and D2 is equal to D1.

The feeding device comprises: a feeding hopper 30, a feeding control unit 40 and a dividing device 50.

The feeding hopper 30 includes a feeding hole 31 and a feeding passage 32 connected to the housing 10.

The feeding control unit 40 is disposed between the feeding hole 31 and the feeding passage 32 and includes an inputting hole 41 and an opposite outputting hole 42 and further includes a rotary shaft 43. Rotating the rotary shaft 43 can change the positions of the inputting and outputting holes 41, 42 with respect to the feeding hole 31.

The dividing device 50 is abutted against the ball-carrying disc 20 and formed with a receiving space 51, and a sub-inputting hole 52 and a sub-outputting hole 53 which are in communication with the receiving space 51. The sub-inputting hole 52 is connected to the feeding passage 32, and the sub-outputting hole 53 is located corresponding to the ball-falling holes 21 of the ball-carrying disc 20.

Figure 3:
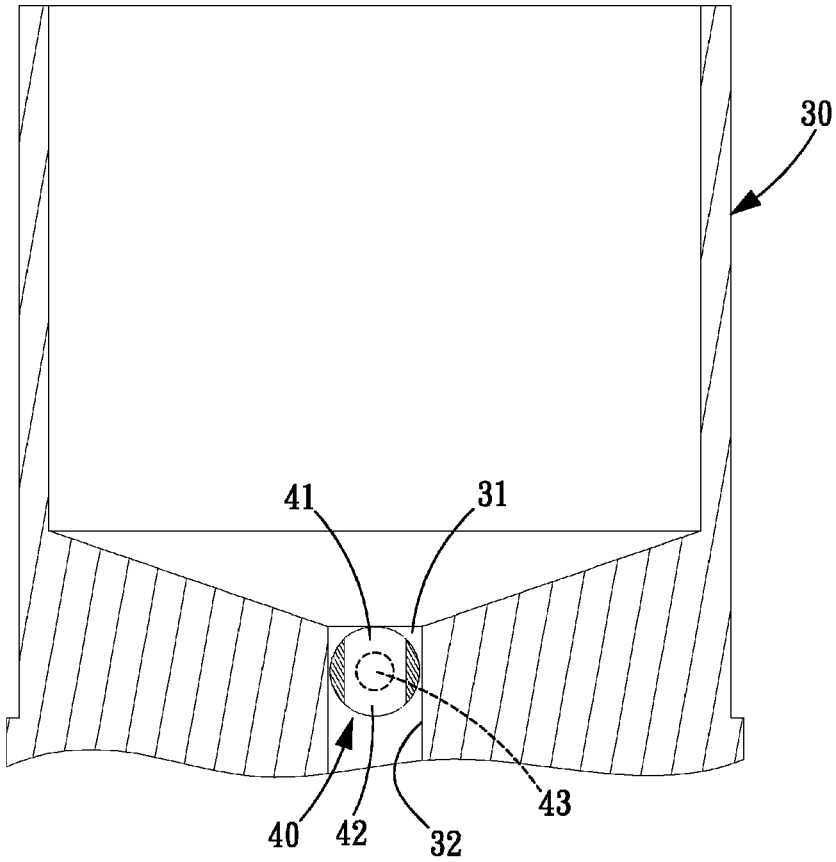
FIG. 3 is a cross sectional view of a part of the feeding device for a balls-sorting machine in accordance with the present invention, showing that the inputting hole of the feeding control unit is fully aligned with the feeding hole of the feeding hopper.
Figure 4:
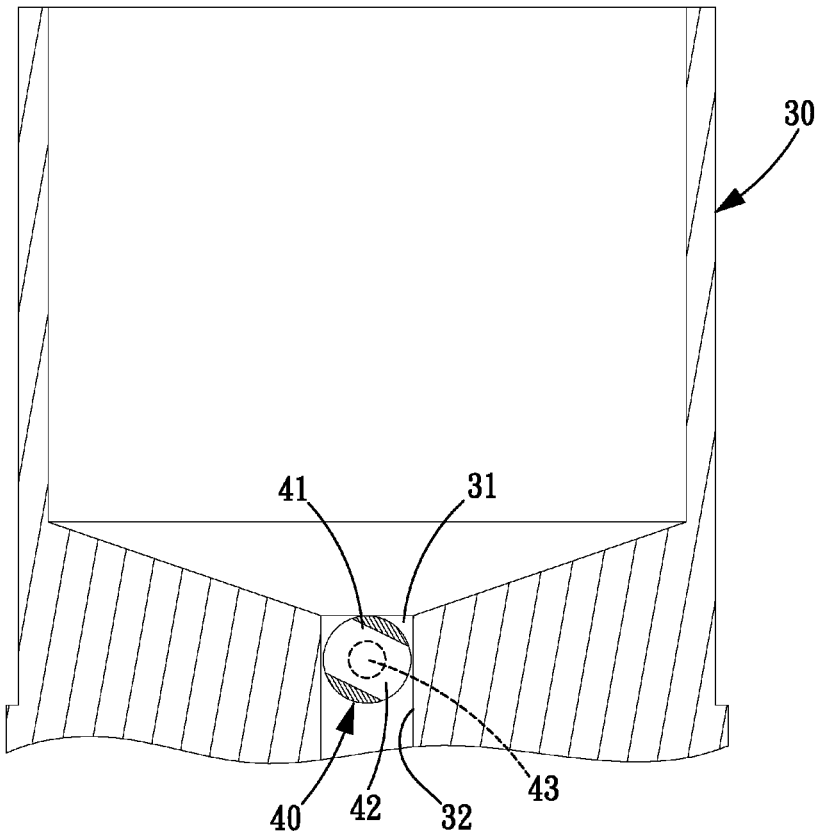
FIG. 4 is a cross sectional view of a part of the feeding device for a balls-sorting machine in accordance with the present invention, showing that the inputting hole of the feeding control unit is misaligned with the feeding hole of the feeding hopper.

When in use, the balls A are poured into the feeding hopper 30 and roll through the feeding hole 31 into the feeding passage 32. The feeding rate of the balls A can be controlled by rotating the rotary shaft 43 of the feeding control unit 40 in such a manner that, when the rotary shaft 43 is rotated to a position as shown in FIG. 3 where the inputting hole 41 of the feeding control unit 40 is fully aligned with the feeding hole 31 of the feeding hopper 30, the balls A can easily enter the feeding passage 32, and at this moment, the feeding rate is maximum. When the rotary shaft 43 is rotated to a position as shown in FIG. 4, where the inputting hole 41 is sort of misaligned with the feeding hole 31, at this moment, the feeding rate is reduced.

Figure 5:
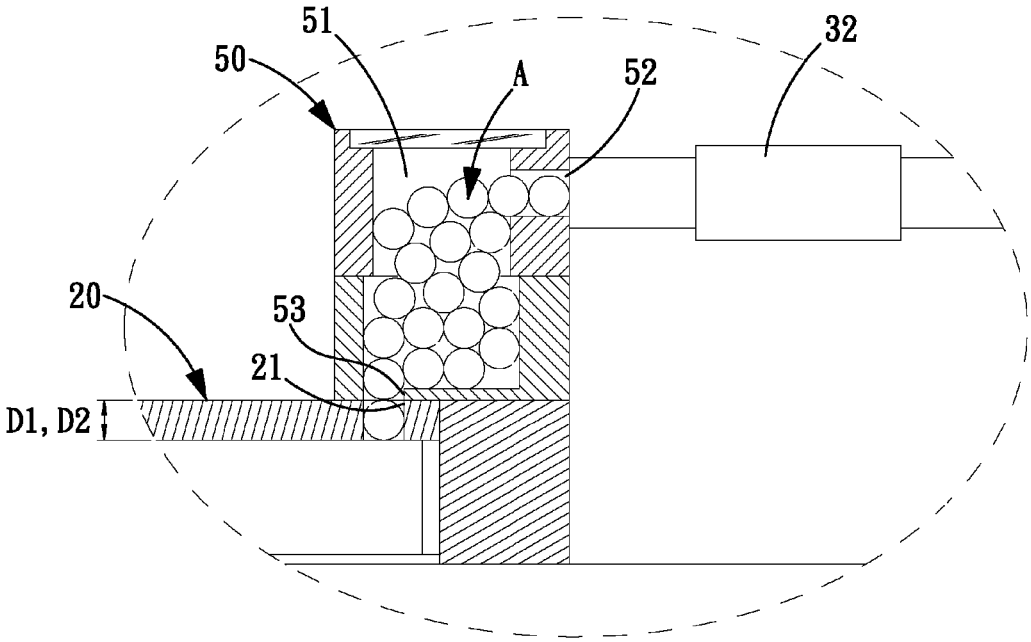
FIG. 5 is a cross sectional view of a part of the feeding device for a balls-sorting machine in accordance with the present invention, showing the structural relation between the dividing device and the ball-carrying disc.

After entering the feeding passage 32, the balls A roll through the sub-inputting hole 52 of the dividing device 50 and into the receiving space 51, and then will roll into the ball-falling holes 21 via the sub-outputting hole 53 which is in communication with the receiving space 51. The ball-carrying disc 20 keeps rotating, so that when the ball-falling holes 21 of the ball-carrying disc 20 are rotated to be aligned with the dividing device 50, the balls A will fall from the dividing device 50 into the ball-falling holes 21. When the ball-falling holes 21 are rotated to be misaligned with the driving device 50, the balls A cannot fall through the ball-falling holes 21 and stay in the receiving space 51. Since the depth D2 of the ball-falling holes 21 is equal to the diameter D1 of the balls A, only one ball A will pass through a ball-falling hole 21 at a time, as shown in FIG. 5. Hence, with the arrangement of the dividing device 50, the ball-carrying disc 20 can carry the balls A, and only one ball A passes through a ball-falling hole 21 at a time.

Figure 6:
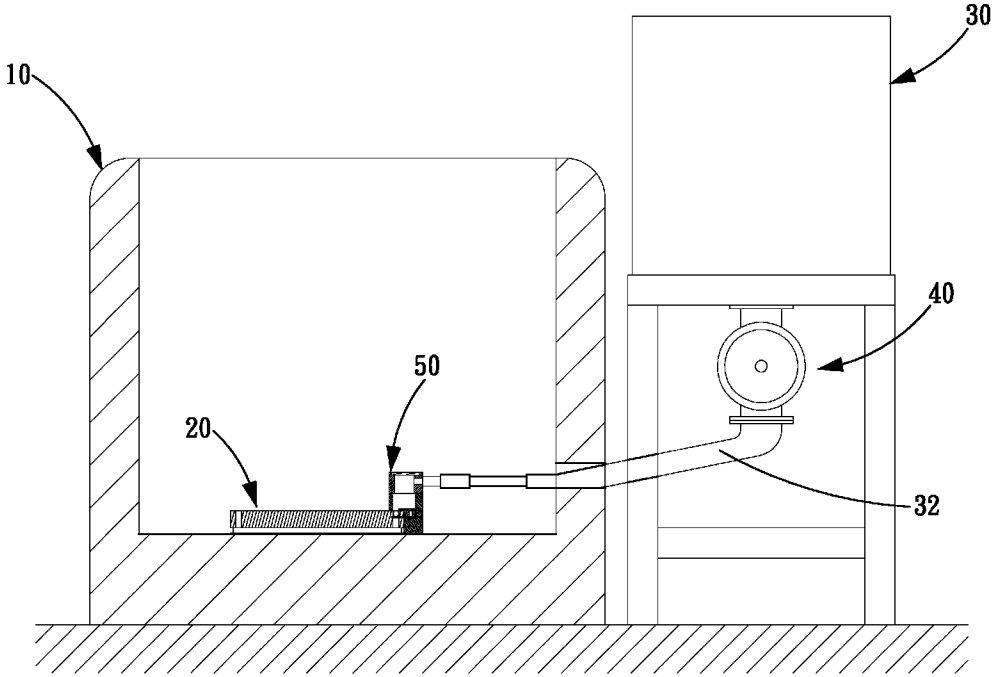
FIG. 6 is a side view of a feeding device for a balls-sorting machine in accordance with another preferred embodiment of the present invention.
Figure 7:
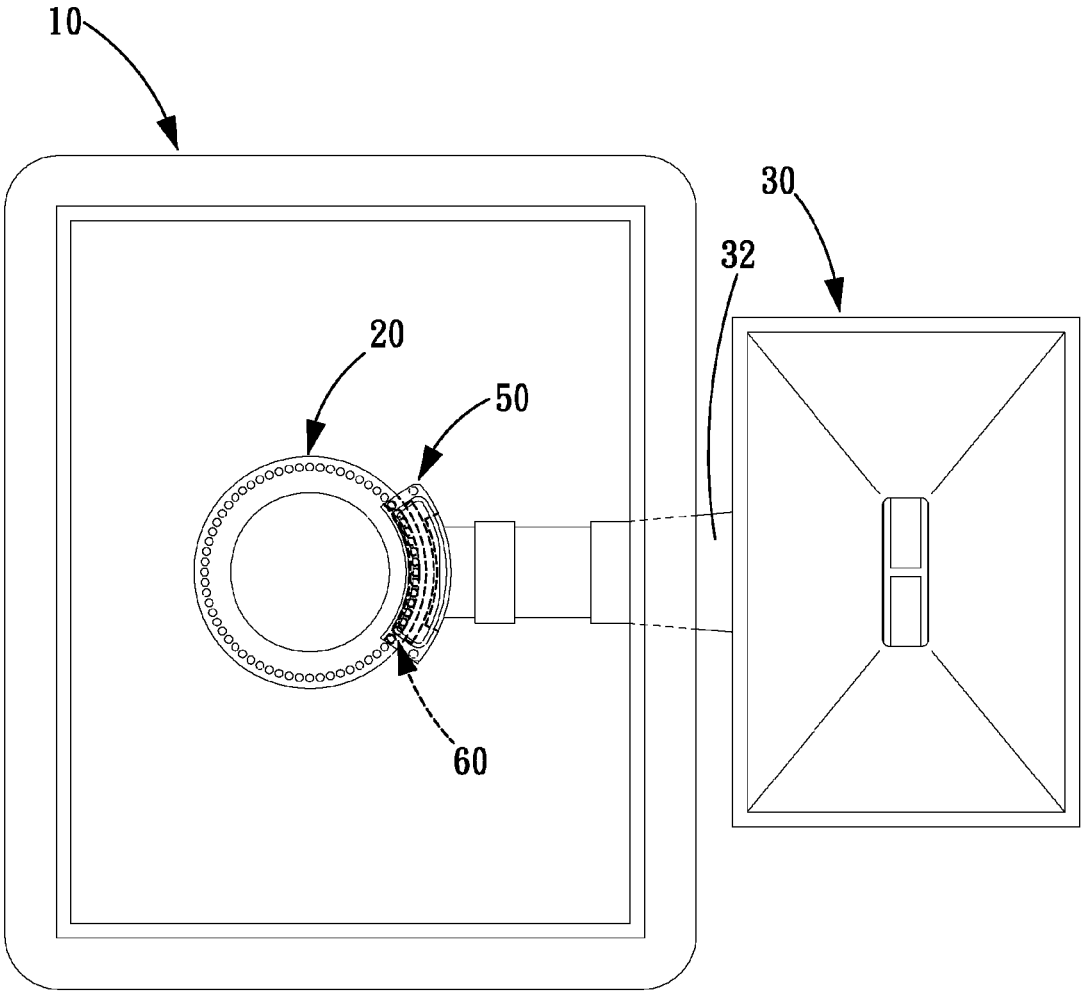
FIG. 7 is a top view of the feeding device for a balls-sorting machine in accordance with another preferred embodiment of the present invention.
Figure 8:
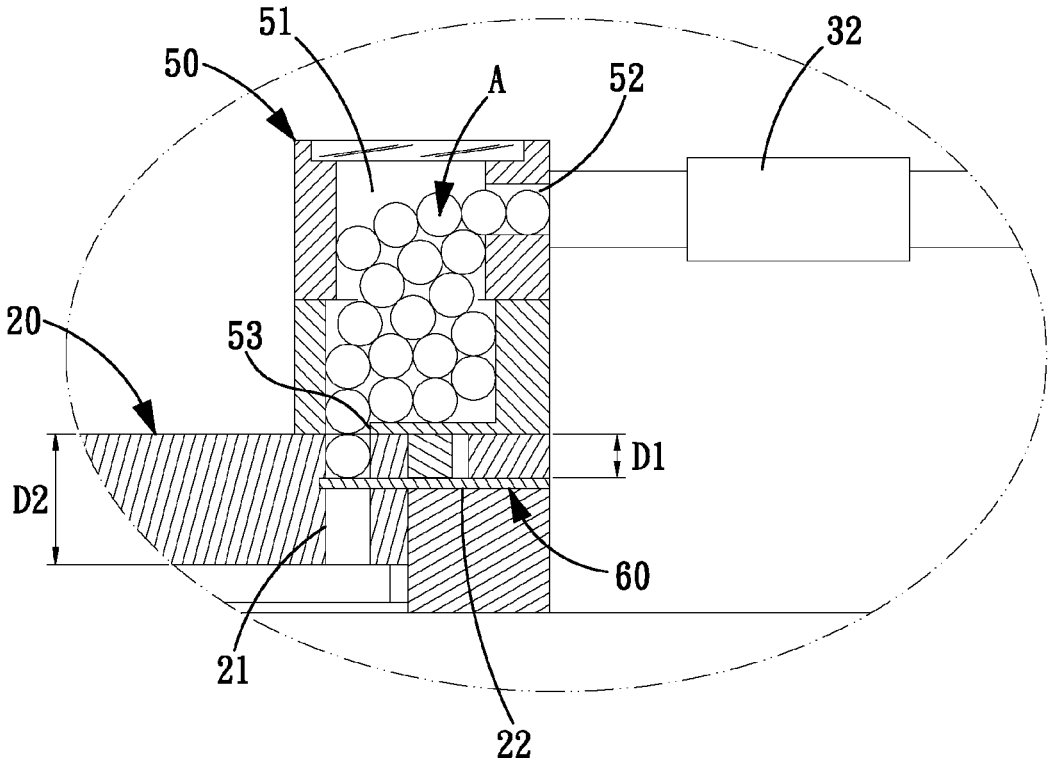
FIG. 8 is a cross sectional view of the feeding device for a balls-sorting machine in accordance with another preferred embodiment of the present invention.

Referring to FIGS. 6-8, another embodiment of the present invention shown in similar to the previous embodiment except that: the ball-carrying disk 20 is formed around the outer periphery thereof with an inserting groove 22 in communication with the ball-falling holes 21, and the depth D2 of the ball-falling holes 21 is greater than the diameter D1 of the balls A. The distance from the inserting groove 22 to the dividing device 50 is equal to the diameter D1 of the balls A. The dividing device 50 is connected to an L-shaped stopping member 60 which extends into the inserting groove 22 of the ball-carrying disc 20 to stop the balls A from passing through the inserting groove 22, and the distance from the stopping member 60 to the dividing device 50 is equal to the diameter D1 of the balls A.

When the ball-falling holes 21 of the ball-carrying disc 20 are rotated to be aligned with the dividing device 50, the stopping member 60 inserts into the inserting groove 22 of the ball-carrying disc 20, the distance from the stopping member 60 to the dividing device 50 is equal to the diameter D1 of the balls A, hence, only one ball A can enter between the stopping member 60 and the dividing device 50 at a time. When the ball-falling holes 21 of the ball-carrying disc 20 are rotated to be misaligned with the dividing device 50, the ball-falling holes 21 are also misaligned with the stopping member 60, so that the balls A can pass through the ball-falling holes 21.

While we have shown and described various embodiments in accordance with the present invention, it is clear to those skilled in the art that further embodiments may be made without departing from the scope of the present invention.

What is claimed is:

1. A feeding device for a balls-sorting machine serving to guide balls to a rotary ball-carrying disc disposed in a housing, the ball-carrying disc being formed with a plurality of ball-falling holes; the feeding device comprising:

a feeding hopper including a feeding hole and a feeding passage connected to the housing;

a dividing device abutted against the ball-carrying disc and formed with a receiving space, and a sub-inputting hole and a sub-outputting hole which are in communication with the receiving space, the sub-inputting hole being connected to the feeding passage, and the sub-outputting hole is located corresponding to the ball-falling holes of the ball-carrying disc; and a feeding control unit disposed between the feeding hole and the feeding passage and including an inputting hole, an opposite outputting hole and a rotary shaft, rotating the rotary shaft can change positions of the inputting and outputting holes with respect to the feeding hole.

2. The feeding device for a balls-sorting machine as claimed in claim 1, wherein a diameter of the balls is equal to a depth of the ball-falling holes.

3. The feeding device for a balls-sorting machine as claimed in claim 1, wherein a diameter of the balls is bigger than a depth of the ball-falling holes, the ball-carrying disk is formed around an outer periphery thereof with an inserting groove in communication with the ball-falling holes, the dividing device is connected to an L-shaped stopping member which extends into the inserting groove of the ball-carrying disc to stop the balls from passing through the inserting groove, and a distance from the stopping member to the dividing device is equal to the diameter of the balls.

* * * * *